US006247270B1

(12) United States Patent
Huml

(10) Patent No.: US 6,247,270 B1
(45) **Date of Patent: *Jun. 19, 2001**

(54) CASEMENT WINDOW ROTO-OPERATORS

(75) Inventor: Jan M. Huml, Medford, WI (US)

(73) Assignee: G-U Hardware, Inc., Newport News, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/358,458

(22) Filed: Jul. 22, 1999

Related U.S. Application Data

(60) Provisional application No. 60/093,710, filed on Jul. 22, 1998.

(51) Int. Cl.[7] ..... E05F 11/24

(52) U.S. Cl. ..... 49/341; 74/545

(58) Field of Search ..... 49/246, 247, 248, 49/333, 335, 337, 339, 341, 345, 460; 74/545

(56) References Cited

U.S. PATENT DOCUMENTS

| | | | |
|---|---|---|---|
| 1,539,549 | | 5/1925 | Ellison . |
| 2,050,403 | | 8/1936 | Weiner . |
| 2,214,280 | | 9/1940 | Lang . |
| 2,321,800 | | 6/1943 | Cordrey et al. . |
| 2,610,848 | | 9/1952 | Carlson et al. . |
| 2,635,485 | | 4/1953 | Gravestine et al. . |
| 2,686,669 | | 8/1954 | Johnson . |
| 2,926,399 | | 3/1960 | Ramunas . |
| 3,044,311 | | 7/1962 | Gagnon . |
| 3,152,368 | | 10/1964 | Stuart . |
| 3,438,151 | | 4/1969 | Evers et al. . |
| 4,253,276 | | 3/1981 | Peterson et al. . |
| 4,266,371 | | 5/1981 | Erdman et al. . |
| 4,301,622 | | 11/1981 | Dunsmoor . |
| 4,305,228 | | 12/1981 | Nelson . |
| 4,823,508 | | 4/1989 | Allen . |
| 4,840,075 | * | 6/1989 | Tucker ..... 49/341 X |
| 4,860,493 | * | 8/1989 | Lense ..... 49/341 X |
| 4,937,976 | | 7/1990 | Tucker et al. . |
| 4,938,086 | | 7/1990 | Nolte et al. . |
| 4,945,679 | | 8/1990 | Aumercier . |
| 5,201,143 | | 4/1993 | Nakanisi . |
| 5,493,813 | | 2/1996 | Vetter et al. . |
| 5,531,045 | * | 7/1996 | Piltingsrud ..... 49/341 X |
| 5,531,138 | * | 7/1996 | Vetter ..... 74/545 X |
| 5,623,784 | | 4/1997 | Kuersten et al. . |
| 5,802,913 | * | 9/1998 | Winner ..... 49/333 |
| 5,815,984 | * | 10/1998 | Sheets et al. ..... 49/246 |
| 5,839,229 | * | 11/1998 | Briggs et al. ..... 49/339 X |

* cited by examiner

*Primary Examiner*—Jerry Redman
(74) *Attorney, Agent, or Firm*—James Creighton Way; Meera P. Narasimhan

(57) ABSTRACT

A window operator, particularly, operators for venting casement windows is provided. The base housing of the operator is of a plastic polymer, which is a non-corrosive and non-thermal conducting material. The top and bottom base components are then sonic welded with a heat-treated steel worm gear welded inside of the plastic base of the window operator creating a one-piece assembly. The worm gear and pinion gear with attached operator arm are placed within the base body before fusion welding the top body. The use of the plastic polymer for the base housing eliminates the possibility of corrosion of the base material. Also, the polymer does not require finishing or painting to protect it from corrosion.

14 Claims, 3 Drawing Sheets

CASEMENT WINDOW ROTO-OPERATORS

This application claims the benefit of U.S. Provisional application Ser. No. 60/093,710, filed Jul. 22, 1998.

BACKGROUND OF THE INVENTION

Most rotary operators are manufactured from metal housings and bases, which typically house a worm gear and activating guide arms. The metal housings are prone to extreme heat conductivity. The metal housings may produce condensation on the interior side of windows fitted with the rotary operators. Condensation occurs at the location of the metal operator. Also, those types of metal operators are in need of paint finishes. Both the metal and the paint are likely to corrode over a period of time.

The other operators on the market are produced from a die-cast zamack material, which breaks down in a seacoast application. The metal therefore requires some type of finish on the outer surface. The interior surfaces of the operator, which includes the operating gears, are left unfinished. Thus, the unfinished interior of the body and the worm gear is prone to corrosion. Another problem with metal operator covers is that the metal of the base housing and the metal of the worm-gear are different metals. Having dissimilar metals in contact creates additional force and friction between the parts, thus causing a high factor of wear on the parts. The high factor of wear increases the chances of the parts failing. The metal operators also conduct heat at a much greater rate than other material types.

A need exists for a rotary operator that is not subject to corrosion, that conducts heat at a low rate thereby eliminating condensation, and that does not have dissimilar metals in contact so that the need for a lubricant is eliminated.

SUMMARY OF THE INVENTION

The present invention relates to window operators, and more specifically, to operators for venting casement windows.

The base housing of the operator is produced from a plastic polymer, which is a non-corrosive and non-thermal conducting material. The top and bottom base components are then sonic welded with the heat-treated steel worm gear welded inside of the plastic base of the window operator creating a one-piece assembly. The worm gear and pinion gear with attached operator arm are placed within the base body before fusion welding the top body.

The use of the plastic polymer for the base housing eliminates the possibility of corrosion of the base material. Also, the polymer does not require finishing or painting to protect it from corrosion.

These and further and other objects and features of the invention are apparent in the disclosure, which includes the above and ongoing written specification, with the claims and drawings.

DETAILED DESCRIPTION OF THE PREFERRED EMBODIMENTS

The present invention relates to window operators, and more specifically, to operators for venting casement windows. The window roto-operator is corrosion resistant. It does not require finishing of any surface or additional coating applied to the operator. The window roto-operator is a one-piece construction, thereby eliminating the need for adhesives or external fasteners. There are no dissimilar metals in operational contact, which eliminates problems associated with frictional contact. That also eliminates the need for lubricant.

Figure 1:
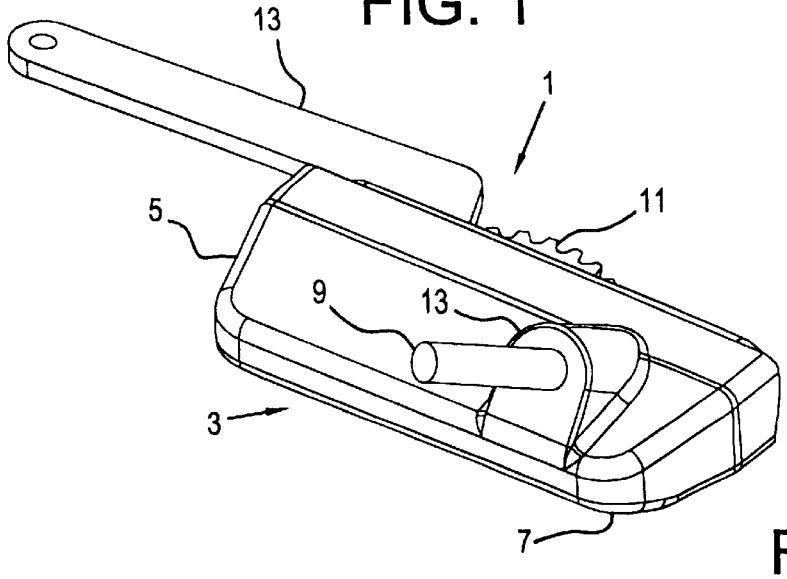
FIG. 1 is a perspective view of the casement window roto-operator.
Figure 2:
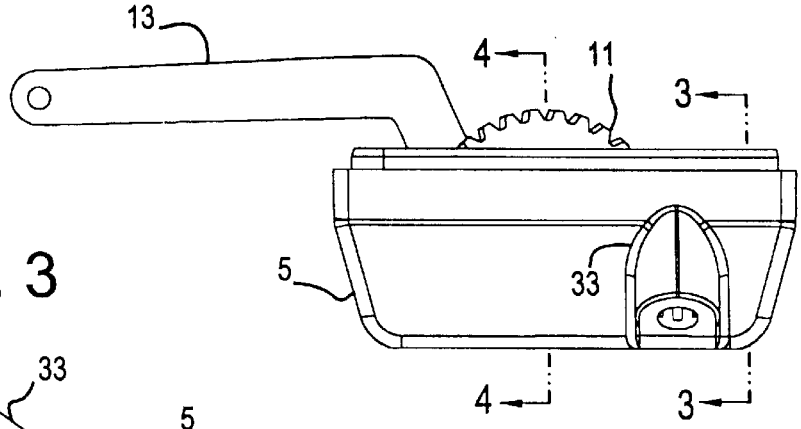
FIG. 2 is a top view of the casement window roto-operator.
Figure 5:
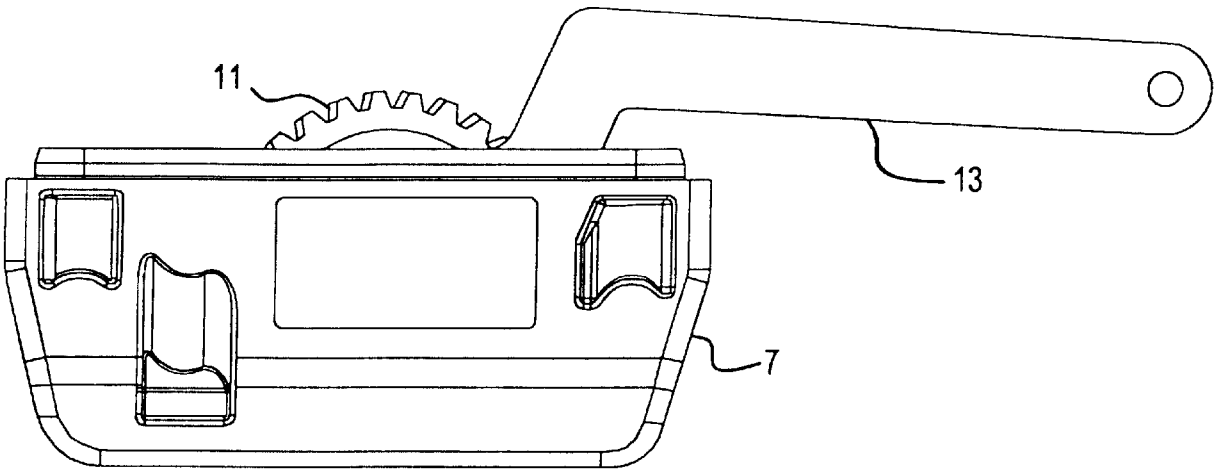
FIG. 5 is a bottom view of the base of the casement window roto-operator.
Figure 6:
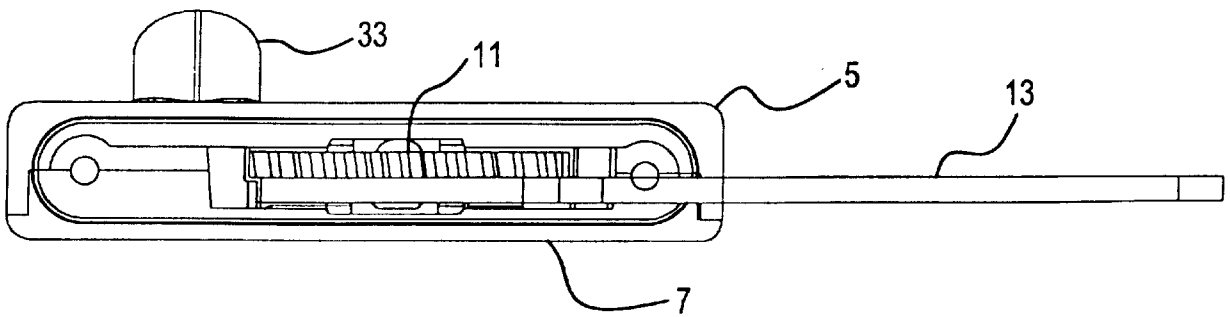
FIG. 6 is a rear view of the casement window roto-operator.

Referring to FIGS. 1, 2, 5 and 6, the base housing 3 of the operator 1 is produced from a plastic polymer, which is a non-corrosive and non-thermal conducting material. The top 5 and bottom base 7 components are then sonic welded with the heat-treated steel worm gear 9 welded inside of the plastic base or the window operator creating a one-piece assembly. The worm gear 9 and opinion gear 11 with attached operator arm 13 are placed within the base body before fusion welding the top body. Receiver 33 of the top base 5 receives the worm gear 9.

The use of the plastic polymer for the base housing 3 eliminates the possibility of corrosion of the base material. Also, the polymer does not require finishing or painting to protect it from corrosion. The plastic polymer conducts heat at a low rate, which eliminates condensation on the interior of the window. Also, the use of a plastic polymer for the base housing eliminates the need for a lubricant since there are no dissimilar metals in operational contact.

Figure 3:
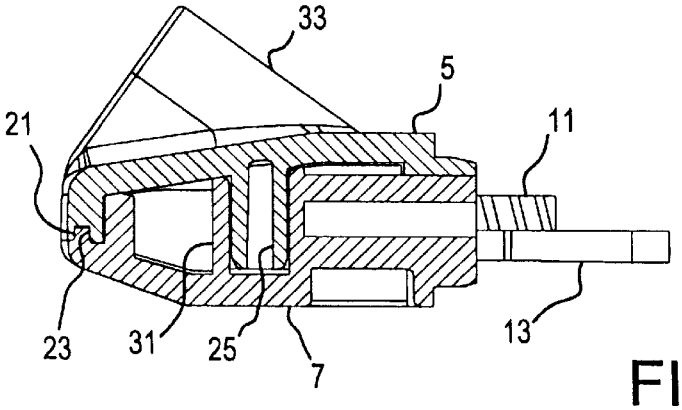
FIG. 3 is a cross-section at 3—3 of the casement window roto-operator of FIG. 2.
Figure 4:
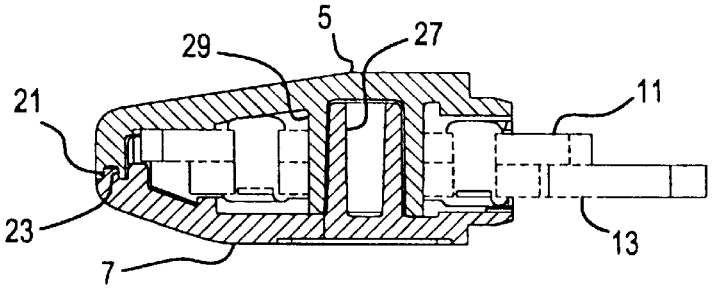
FIG. 4 is a cross-section at 4—4 of the casement window roto-operator of FIG. 2.
Figure 7:
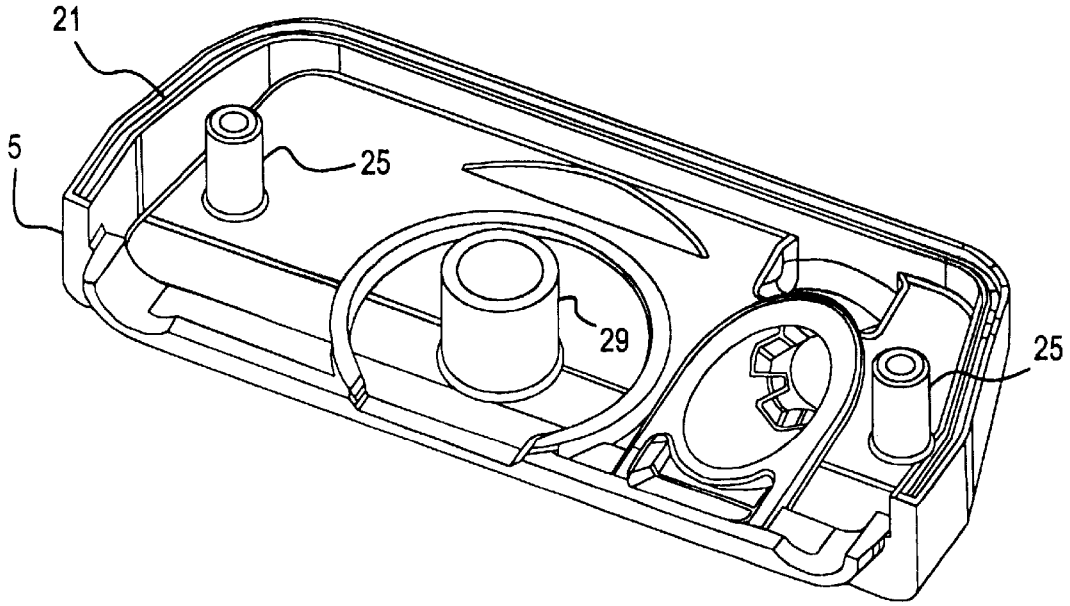
FIG. 7 is a top view of the base of the casement window roto-operator.
Figure 8:
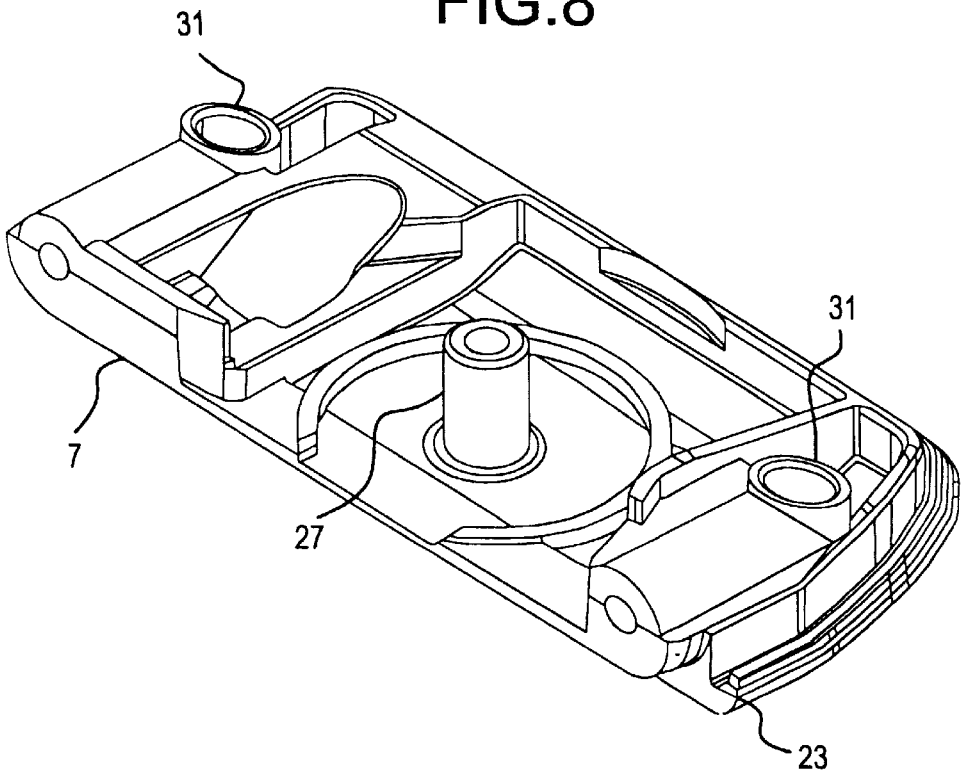
FIG. 8 is an interior view of the top cover of the casement window roto-operator.

Referring to FIGS. 3, 4, 7 and 8, groove 21 in the top base 5 receives lip 23 in the bottom base 7 for securing the two base components together. Receptacles 31 in the bottom base 7 receive posts 25 in the top base 5 upon sealing the two base components together. Receptacle 29 in the top base 5 receives post 27 in the bottom base upon sealing the two base components together. Once the top 5 and bottom base 7 components are mechanically connected, they are then sonic welded to form a one-piece assembly.

While the invention has been described with reference to specific embodiments, modifications and variations of the invention may be constructed without departing from the scope of the invention, which is defined in the following claims.

I claim:

1. A casement window operator apparatus comprising a shaft-operated worm gear, a pinion gear meshed with the worm gear, and operator arm connected to the pinion gear a non-corrosive unitary one-piece housing capturing and enclosing the worm gear and at least portions of the pinion gear and the operator arm, the housing having a bottom base and a top base, complementary interfitting lips and grooves in the top base and bottom base, the lips and grooves being welded, flowed and fused together thereby forming the unitary one-piece housing.

2. The apparatus of claim 1, further comprising complementary interfitting posts and receptacles extending inward from the top base and the bottom base and interfitting with each other, with the inward extending receptacles receiving the opposite inward extending complementary posts.

3. The apparatus of claim 1, wherein the housing is of thermo-resistant and corrosion resistant material.

4. The apparatus of claim 3, wherein the material is plastic.

5. The apparatus of claim 1, wherein the worm gear and pinion gear are of similar material.

6. The apparatus of claim 1, wherein the worm gear is of heat-treated material.

7. The apparatus of claim 6, wherein the material is steel.

8. The apparatus of claim 1, wherein the pinion gear is of heat-treated material.

9. The apparatus of claim 8, wherein the material is steel.

10. The apparatus of claim 1, further comprising an arm connected to the pinion gear for connecting to a window.

11. The apparatus of claim 10, further comprising openings in the arm for receiving window fasteners.

12. The apparatus of claim 1, further comprising a driver connected to the worm gear for driving the worm gear.

13. The apparatus of claim 12, wherein the driver is a rotatable arm.

14. A casement window operator apparatus comprising a shaft-operated worm gear, a pinion gear meshed with the worm gear, and operator arm connected to the opinion gear a non-corrosive unitary one-piece housing capturing and enclosing the worm gear and at least portions of the pinion gear and the operator arm, the housing having a bottom base and a top base, complementary interfitting lips and grooves in the top base and bottom base, the lips and grooves being welded, flowed and fused together thereby forming the unitary one-piece housing, the housing further comprising complementary interfitting posts and receptacles extending inward from the top base and the bottom base and interfitting with each other, with the inward extending receptacles receiving the opposite inward extending complementary posts, the complementary posts and receptacles comprising a relatively large hollow cylindrical receptacle extending downward from the top base and a large hollow cylindrical post extending upward from the bottom base and fitting tightly within the large hollow cylindrical receptacle forming a hub on which the pinion gear is mounted and further comprising relatively smaller hollow cylindrical receptacles extending upward from the bottom base and hollow cylindrical posts extending downward from the top base and tightly engaging inside walls of the relatively smaller hollow cylindrical receptacles.

* * * * *